United States Patent [19]

Baird

[11] Patent Number: 4,634,390

[45] Date of Patent: Jan. 6, 1987

[54] RAISING AND LOWERING AID FOR TROLLING MOTORS

[76] Inventor: John S. Baird, 9600 Baird Rd., Shreveport, La. 71118

[21] Appl. No.: 785,978

[22] Filed: Oct. 10, 1985

[51] Int. Cl.[4] ..... B63H 21/26

[52] U.S. Cl. ..... 440/63; 440/55; 248/642

[58] Field of Search ..... 248/642; 440/6, 55, 440/56, 63, 65, 53

[56] References Cited

U.S. PATENT DOCUMENTS

| | | | |
|---|---|---|---|
| 3,724,790 | 4/1973 | Harris et al. | 248/642 |
| 3,948,472 | 4/1976 | Metcalf | 248/642 |
| 4,033,530 | 7/1977 | Harris | 248/642 |
| 4,168,818 | 9/1979 | Ellis | 440/55 |

*Primary Examiner*—Trygve M. Blix
*Assistant Examiner*—Thomas J. Brahan
*Attorney, Agent, or Firm*—John M. Harrison

[57] ABSTRACT

A raising and lowering aid for trolling motors which includes a pair of torsion springs, each having one end fixed with respect to the deck fixture of the trolling motor bracket and the opposite end engaging a pair of connector bars which are pivotally mounted to the deck fixture at one end and slidably mounted at the opposite end to conventional, parallel pivoting primary arms, also pivotally supported by the mount shoe. The springs are adjustable with respect to the deck fixture in order to adjust the spring tension and the raising and lowering aid operates to assist the user in retracting the trolling motor from the water on the bracket and lowering the trolling motor into the water from the bracket during operation.

20 Claims, 8 Drawing Figures

RAISING AND LOWERING AID FOR TROLLING MOTORS

BACKGROUND OF THE INVENTION

1. Field of the Invention

This invention relates to electric trolling motors for fishing boats. More particularly, the invention relates to a raising and lowering aid for trolling motors which is characterized by a pair of coil springs having one end fixedly attached by means of tension adjusting bolts to a deck fixture in association with the trolling motor mount bracket and the opposite end secured to spring anchor bolts which are threaded in pivotally mounted connector bars provided in slidably association with the conventional pivoting primary arms of the trolling motor mount bracket. The springs are designed to help lift the trolling motor from the water and to cushion the drop of the trolling motor into the water during the raising and lowering operation. In a preferred embodiment of the invention the torsion springs are adjustably mounted on cylindrically-shaped mandrels in order to vary the spring tension, such that the trolling motor can be easily raised from the water and lowered into the water with a minimum of effort. The raising and lowering aid of this invention is designed for compatibility with conventional mount brackets which accommodate retractable trolling motors and the device can be quickly and easily installed with a minimum of effort and time to assist the user in raising and lowering a trolling motor while fishing.

2. Description of the Prior Art

Trolling motors of various design are currently used in order to more efficiently guide a boat while fishing, docking or in other low speed propulsion situations. Typical of these trolling motors is the "Manually Operated Boat Propulsion Means" disclosed in U.S. Pat. No. 2,835,217, dated May 20, 1958, to J. C. Newberry. The Newberry motor is hand-operated and consists of a frame with a vertical propeller shaft housing rotatably supported in the frame and provided with an automatic latch mechanism for securing the propeller in angular adjusted position with respect to the longitudinal axis of the boat, in order to lock the propeller in a position for steering the boat either along a straight or a circular course. The propeller is operated by turning a crank which is attached to the frame by means of a gearbox and the speed of the propellor is directly proportional to the operational speed of the crank. An "Adjustable Retracting Outboard Motor Bracket" is disclosed in U.S. Pat. No. 3,032,304, dated May 1, 1962, to H. A. Machlan. The Machlan motor bracket is designed to receive an outboard motor and is foldable on the stern of a boat to adjust the outboard motor at varying distances from the stern. The bracket folds into a parallelogram and is braced by a chain for variable adjustment with respect to the stern. U.S. Pat. No. 3,629,885, dated Dec. 28, 1971, to Ralph E. Jackson, includes a motor-mounting bracket having an upright plate-like member at the bow and a transverse pin mounted in the plate-like member, with lugs swingably mounted on the pin on opposite sides of the plate-like member. A mounting bracket is also provided, which bracket is swingable with the lugs between an extended position in which the end portion of the bracket extends outwardly of the boat and a retracted position inside the boat. A "Folding Accessory Bracket Assembly" is disclosed in U.S. Pat. No. 3,861,628, dated Jan. 21, 1975, to George H. Krieger. This device includes a bracket assembly for mounting a boat accessory to the deck of a boat, which assembly is particularly well adapted for mounting a trolling motor to automatically position the motor vertically in the water in an extended position and parallel to and on top of the boat deck in a retracted position. The bracket assembly includes a mounting means attached to the boat deck and an accessory bracket for mounting the motor, and arm means are pivotally mounted between the mounting means and bracket for automatically positioning the bracket as the arm means are pivoted, to properly position the motor in the extreme positions.

The raising and lowering aid for trolling motors of this invention is designed for use with trolling motors mounted on bracket assemblies which are similar in design to the Krieger folding accessory bracket assembly. The thrust of this invention is to provide a means for aiding the user in both lowering a trolling motor into the water from a retracted position on the deck of a boat and raising the trolling motor back to the retracted position with reduced effort. It is therefore an object of this invention to provide a new and improved raising and lowering aid for trolling motors which raising and lowering aid exerts tension on the trolling motor mount bracket arms to assist in lowering the trolling motor from a retracted position on the boat deck into the water and subsequently raising the trolling motor from the water back to the retracted position on the deck.

Another object of this invention is to provide a new and improved raising and lowering aid for trolling motors which includes a pair of coil springs mounted in torsional association with the deck fixture of the trolling motor mount bracket and engaging a pair of connector bars at one end, which connector bars are slidably mounted at the opposite ends to conventional primary arms carried by the trolling motor bracket, in order to assist in alternately folding the trolling motor into a retracted position on the bracket and lowering the trolling motor from the retracted position into the water.

Still another object of this invention is to provide a raising and lowering aid for trolling motors of various design, which aid is characterized by a pair of oppositely-disposed torsion springs, each having one end fixedly secured to an adjusting bolt threaded in the trolling motor deck fixture and the opposite end secured to an anchor bolt attached to one of two connector bars which are slidably mounted in parallel relationship to the primary arms of the motor mount bracket for exerting an upward force on the primary arms in order to better facilitate lowering of the trolling motor into the water from a retracted position on the boat deck and subsequently raising the trolling motor from the water back into the retracted position on the deck.

Yet another object of the invention is to provide a raising and lowering aid for assisting in the deployment and retraction of electric trolling motors, which aid includes a pair of torsion springs positioned on mandrels bolted to either side of the trolling motor deck fixture and adapted to tension a pair of cooperating connector bars which are pivotally carried by the deck fixture and slidably cooperate with conventional primary arms, whereby the primary arms are also tensioned to counteract the influence of gravity in the deployment and retraction operation.

SUMMARY OF THE INVENTION

These and other objects of the invention are provided in a new and improved raising and lowering aid for trolling motors which includes a pair of coil springs mounted in torsional configuration to the trolling motor deck fixture, each spring having one end fixed with respect to the deck fixture and the opposite end engaging an anchor bolt which is attached to one of a pair of parallel connector bars pivotally carried by the deck fixture, with the opposite ends of the connector bars slidably engaging parallel primary arms pivotally attached to the mount shoe in spaced relationship with respect to the springs, whereby the springs exert tension on the connector bars and the primary arms to aid in lowering the trolling motor from a retracted position on a boat deck into the water and subsequently raising the trolling motor from the water back into the retracted position on the deck.

BRIEF DESCRIPTION OF THE DRAWINGS

The invention will be better understood by reference to the accompanying drawings, wherein.

DESCRIPTION OF THE PREFERRED EMBODIMENTS

Figure 1:
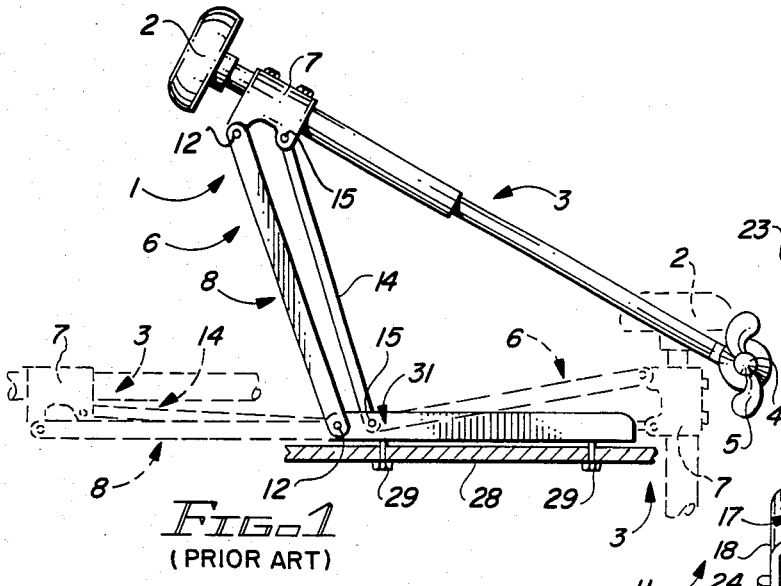
FIG. 1 (PRIOR ART)
FIG. 1 is a perspective view of a conventional electric trolling motor mounted on a conventional folding mount bracket.

Referring initially to FIG. 1 of the drawings a conventional trolling motor and trolling motor mount bracket is generally illustrated by reference numeral 1 and includes a motor head 2, fitted with a shaft 3 and a drive motor 4 at the opposite end of the shaft 3. A propeller 5 is mounted on a shaft which extends from the drive motor 4 in conventional fashion and the trolling motor 1 is illustrated mounted on a conventional pivoting bracket which is generally illustrated by reference numeral 6. The pivoting bracket 6 includes a shaft bracket 7, which encircles and adjustably receives the shaft 3 and a pair of primary arms 8 extend from the shaft bracket 7 to a deck fixture 27 and are secured in position by means of shaft bracket pins 12, in order to effect retraction and extension of the trolling motor 1 with respect to the deck fixture 27. A stabilizing arm 14 extends between the shaft bracket 7 and the mount shoe 31 in order to facilitate folding of the trolling motor 1 and is mounted by means of stabilizing arm pin 15. The mount shoe 31 is in turn secured to the boat deck 28 by means of deck mount bolts 29 and cooperating nuts (not illustrated). Accordingly, as further illustrated in FIG. 1, the trolling motor 1 can be folded into a flat configuration illustrated in phantom in the left-hand portion of FIG. 1, with the shaft 3 substantially parallel to the bolt deck 28 and can alternatively be extended from the deck 28 into a functional position, also illustrated in phantom in the right-hand portion of FIG. 1. A cord (not illustrated) which can be attached to the shaft bracket 7, is commonly used to pull the trolling motor 1 into retracted position and release the trolling motor 1 into deployed position, as desired.

Referring now to FIGS. 1–6 of the drawing in a preferred embodiment, the raising and lowering aid of this invention is generally illustrated by reference numeral 11 and includes a pair of torsion springs 34, which are wound on cylindrically-shaped spring mandrels 41. The spring mandrels 41 are attached in oppositely-disposed relationship to the upward standing side flanges 33 of the deck fixture 27 by a pair of spring bolts 24, which extend through the mandrel apertures 42 and are threaded into spring bolt apertures 26 located in the side flanges 33. The spring bolts 24 also extend through a pair of washers and a spacer and through the base end aperture 16 of the base end 18 of each one of a pair of parallel connector bars 17, and then through the stop disk aperture 48 of each one of a pair of stop disks 47 which lie adjacent the spring mandrels 41 and the deck fixture 27. The stop disks 47 are each slightly larger in diameter than the diameter of the torsion springs 34 and include a stop disk flange 49, which is designed to engage the spring hook 35 of a corresponding torsion spring 34, when the trolling motor 1 is retracted on the mount shoe 31, in order to release the tension applied to the connector bars 17 at a preselected point in the retraction path. Node apertures 50 are provided in arcuate, spaced relationship in each stop disk 47 in order to selectively receive a node 45, projecting from the disk end 43 of each spring mandrel 41, respectively, and locate this preselected point. Tension can therefore be released from the connector bars 17 at selected points in the retraction path by the selection of a specific node aperture 50 for insertion of the node 45. The spring hooks 35 of each of the torsion springs 34 engage oppositely-disposed spring anchor bolts 40, which are threadably inserted in the face end 18 of each connector bar 17, respectively, to anchor the pivoting ends of the torsion springs 24. Alternatively, it will be appreciated that the spring anchor bolts 40 can be replaced by pins such as roll pins, which are mounted in the base end 18 of the connector bars 17, as desired. The function of the spring anchor bolts 40 is to engage the spring hooks 35 of the torsion springs 34 as the connector bars 17 pivot on the side flanges 33 of the deck fixture 27. This parallel orientation of the spring hooks 35 with the connector bars 17, respectively, is interrupted in the retraction mode when the spring hooks 35 contact the two stop disk flanges 49 in the stop disks 47 as the trolling motor 1 swings rearwardly. The opposite end or spring tag 36 of each of the torsion springs 34 is secured to opposite side flanges 33 of the deck fixture 27 by means of tension adjusting bolts 38, which threadably and selectively engage the spring tension apertures 39 in the side flanges 33, from the outside. Each spring mandrel 41 is also fitted with a dog 46, which projects outwardly of the bar end 44 of the corresponding spring mandrel 41 and is designed to engage a dog aperture 55, provided in each of the side flanges 33, to stabilize the spring mandrels 41 with respect to the deck fixture 27.

Figure 4:
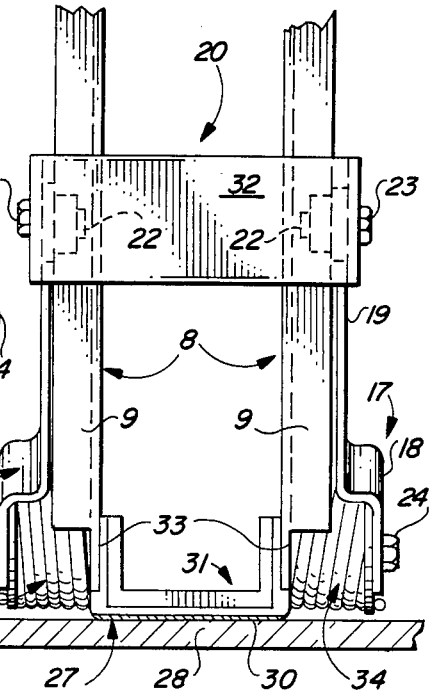
FIG. 4 is a rear elevation, partially in section, of the trolling motor raising and lowering aid illustrated in FIG. 2.
Figure 8:
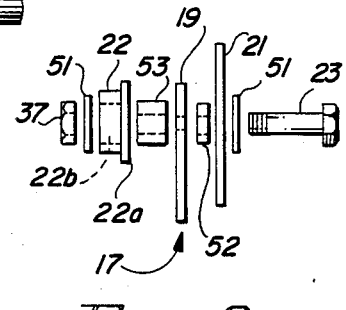
FIG. 8 is an exploded view of a preferred embodiment of the roller assembly.
Figure 5:
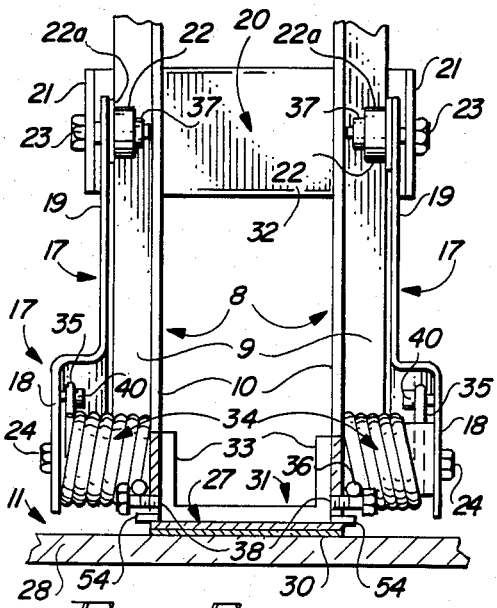
FIG. 5 is a front elevation, partially in section, of the trolling motor raising and lowering aid illustrated in FIGS. 2 and 4.
Figure 6:
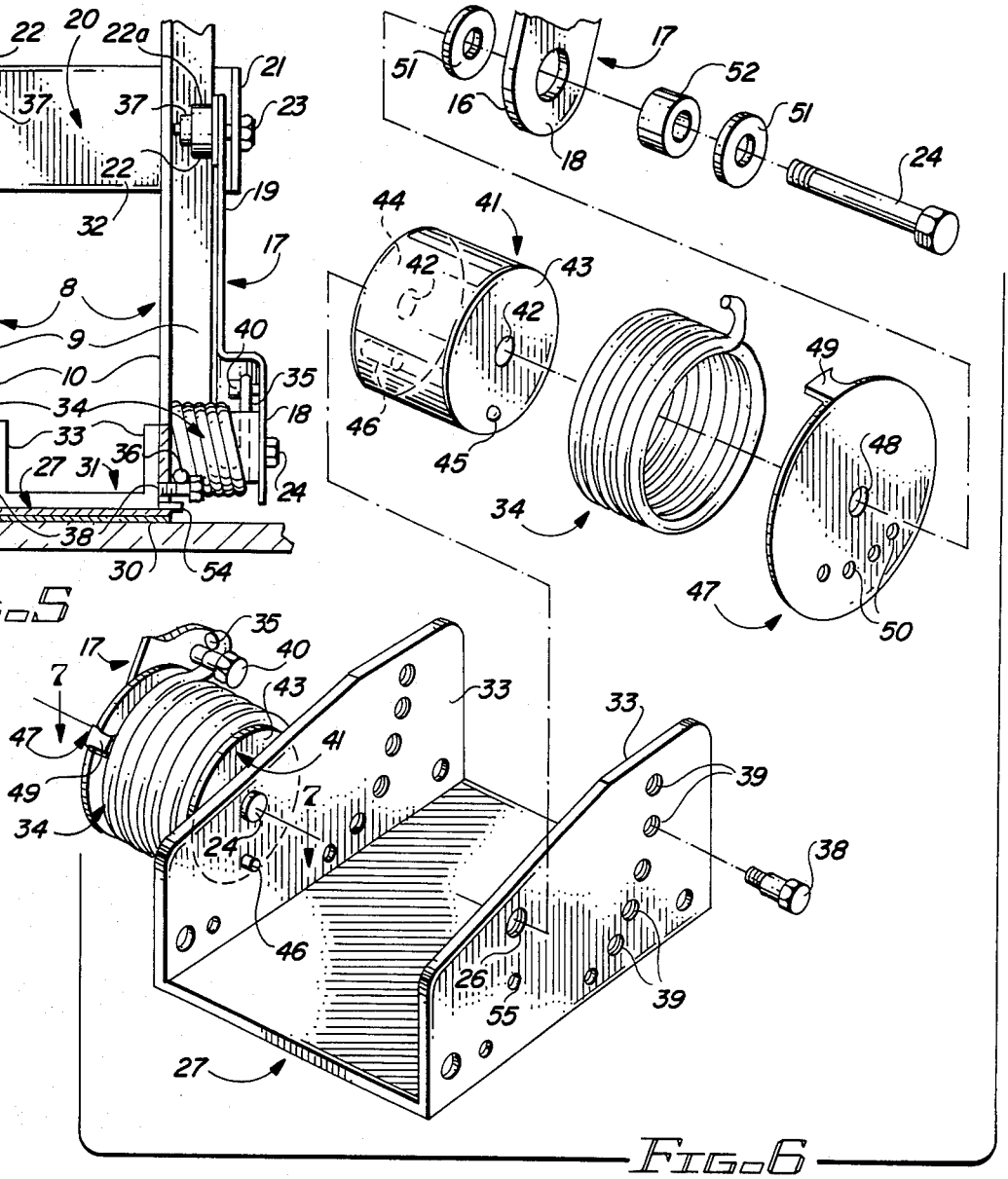
FIG. 6 is an exploded view of a preferred embodiment of the coil spring and spring mounting assembly of the raising and lowering aid for trolling motor of this invention.
Figure 7:
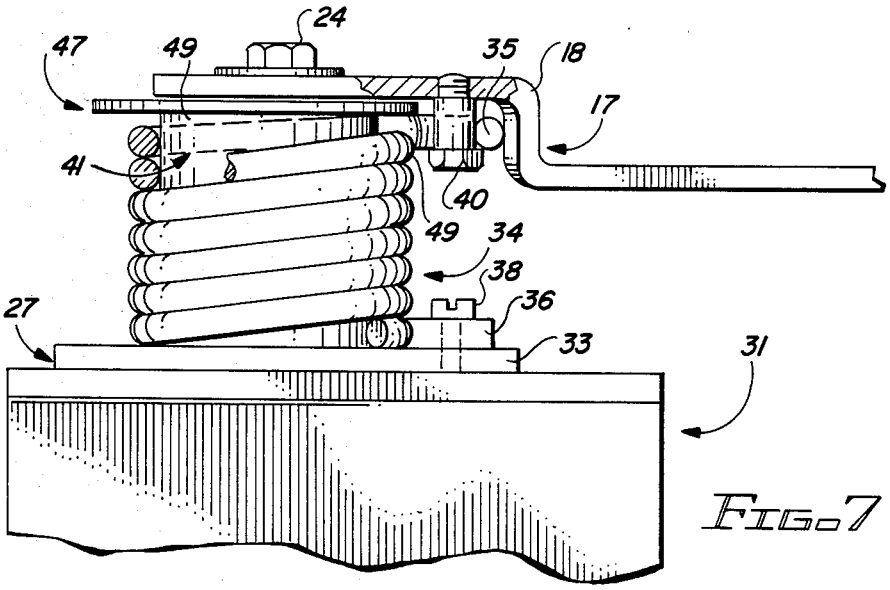
FIG. 7 is a partial sectional view, taken along line 7—7 of the coil spring illustrated in FIG. 6.

Referring now to FIGS. 2-5, 7 and 8 of the drawings in a preferred embodiment of the invention the connector bars 17 are each offset outwardly of the deck fixture 27 at the base end 18 in order to accommodate the torsion springs 34. The plate ends 19 of the connector bars 17 extend toward the primary arms 8 in parallel relationship, and are also parallel to the bottom flange 10 of the primary arms 8. A keeper plate 20 is provided with parallel connecting flanges 21 spaced by a cross plate 32, which connecting flanges 21 are connected to the plate ends 19 of the connector bars 17 by means of roller bolts 23. As illustrated in FIGS. 4, 5 and 8 of the drawings, the roller bolts 23 extend through openings (not illustrated) in the connecting flanges 21 of the keeper plate 20, through a spacer 52 and apertures (not illustrated) in the plate ends 19 of the respective connector bars 17 and receive a bushing 53, a pair of washers 51 and a nut 37, to rotatably maintain the rollers 22 on the roller bolts 23, respectively. The rollers 22 are each characterized by a roller flange 22*a* on one edge thereof and a roller cavity 22*b*, which receives the bushing 53 to facilitate easy rotation of the rollers 22 on the top flanges 9 of the primary arms 8, respectively. As further illustrated in FIGS. 4 and 5 of the drawings, the rollers 22 are positioned in engagement with the top flanges 9 of the primary arms 8, with the roller flanges 22*a* engaging the outside edges of the top flanges 9, respectively, as illustrated. Accordingly, referring again to FIGS. 2 and 3, it will be appreciated that as the trolling motor 1 is alternately moved into the retracted and operational positions illustrated in phantom in FIG. 1, the keeper plate 20 traverses the primary arms 8 on the rollers 22 to maintain the rollers 22 on the top flanges 9 of the primary arms 8. The slide buttons 25, which are secured to the cross plate 32 of the keeper plate 20, serve to reduce friction between the cross plate 32 and the top flange 9 of the primary arm 8 as the keeper plate 20 traverses the parallel primary arms 8.

Referring again to FIGS. 1-3 of the drawings in a most preferred embodiment of the invention the deck fixture 27 is removably secured to the mount shoe 31 by means of set screws 54, which are threaded into the side flanges 33 of the deck fixture 27 and tightly engage the mount shoe 31. Since the mount shoe 31 is secured to the deck 28 by means of the deck mount bolts 29, the raising and lowering aid 11 is securely fixed with respect to the deck 28. A deck fixture pad 30 is also positioned between the deck fixture 27 and the boat deck 28 for cushioning purposes.

Figure 2:
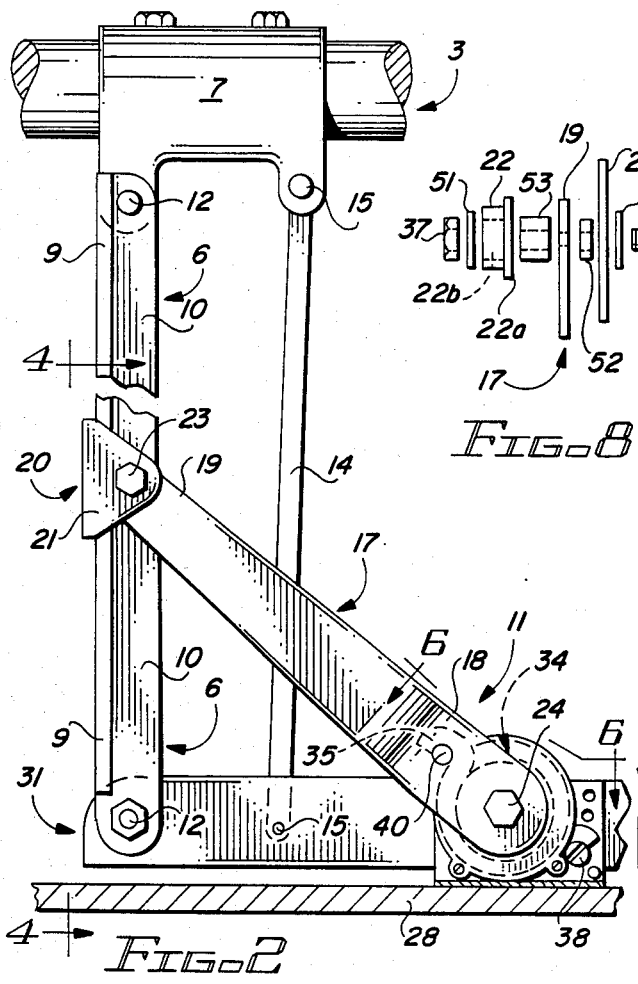
FIG. 2 is a right side elevation, partially in section, of a portion of the trolling motor bracket illustrated in FIG. 1, with the raising and lowering aid of this invention mounted thereon and the trolling motor oriented parallel to the boat deck.
Figure 3:
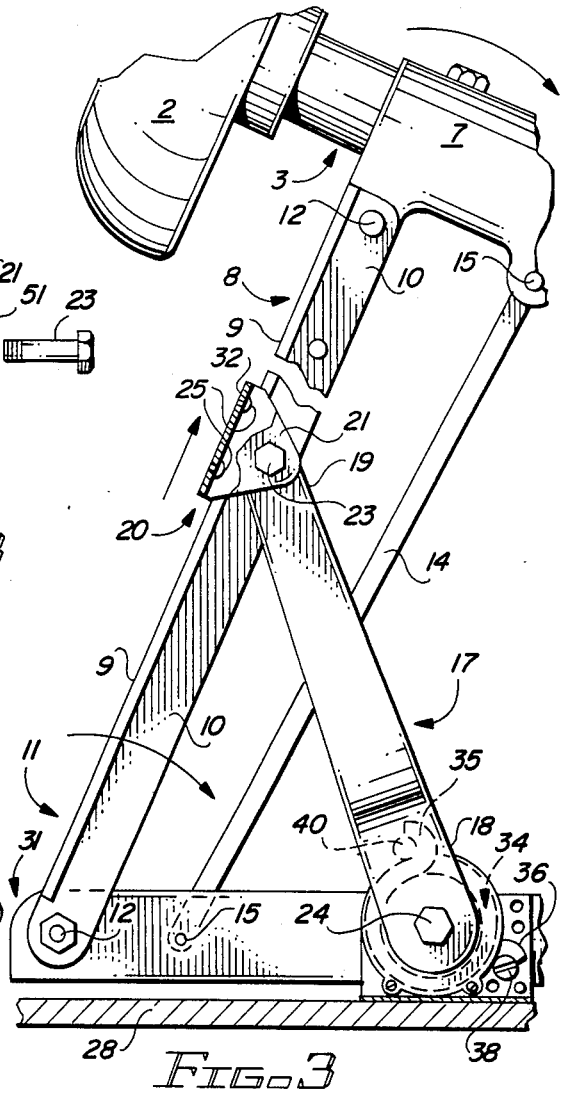
FIG. 3 is a right side elevation, partially in section, of the conventional trolling motor and the raising and lowering aid illustrated in FIG. 2, with the trolling motor maneuvered toward deployment in functional position forward of the boat.

In operation, and referring again to FIGS. 1-3 and 7 of the drawings, when it is desired to retract the trolling motor from an extending, operational position forward of the boat and perpendicular to the boat deck 28 as illustrated in phantom in the right portion of FIG. 1, the trolling motor 1 is first lifted to the position illustrated in FIG. 1. This lifting operation is assisted by the torsion springs 34, since the torsion springs 34 are in a position of maximum tension when the trolling motor 1 is in the water, as shown in FIGS. 2 and 3. Accordingly, as the trolling motor 1 is lifted to the position illustrated in FIG. 1, the torsion springs 34 serve to minimize the effort necessary to raise the trolling motor 1 against the pull of gravity. The duration of application of this assisting tension can be adjusted such that tension is released from the torsion springs 34 when the trolling motor 1 is in the upright position, by choosing a specific node aperture 50 in the stop disk 47, for engagement by the node 45 located in the disk end 43 of the respective spring mandrels 41. This adjustment can be achieved when the trolling motor 1 is in the retracted position and the torsion springs 34 are relaxed, by loosening the spring bolts 24, removing each node 45 from the corresponding node aperture 50 and engaging the node 45 with another selected node aperture 50. Retraction of the trolling motor 1 from the orientation illustrated in FIG. 2 into the position illustrated in phantom in the left portion of FIG. 1 is therefore achieved without the assistance or intervention of the torsion springs 34. Similarly, when it is desired to again extend the trolling motor 1 into the functional, operating position from the retracted location, the trolling motor 1 is first lifted to the position illustrated in FIG. 1 to engage the spring anchor bolts 40 with the spring hooks 35 of the torsion springs 34 and the tension in the torsion springs 34 increases as the trolling motor 1 is moved forwardly, and again reaches a maximum when the trolling motor 1 is in the operational position forward of the boat. Accordingly, moving of the trolling motor 1 into this operational position is aided by the tension in the torsion springs 34 and deployment requires very little effort and also minimizes the chance of damage to the trolling motor 1 or to the pivoting bracket 6 as the trolling motor 1 is lowered into the operational configuration against the spring tension.

Referring now to FIGS. 1, 2, 3 and 7, when the trolling motor 1 is in the position illustrated in FIGS. 1 and 2, tension on the connector bars 17 is released, since the spring hook 35 is rotated in the counterclockwise direction against the stop disk flanges 49 to disengage the corresponding spring anchor bolt 40. Furthermore, movement of the trolling motor forwardly in the direction of the arrow as illustrated in FIG. 3 also moves the spring hook 35 forwardly in a clockwise direction, thus disengaging the stop disk flanges 49, engaging the spring anchor bolts 40, tensioning the torsion springs 34 and aiding movement of the trolling motor 1 into operational configuration in the water, as heretofore described. It will be appreciated that the tension in the torsion springs 34 can be adjusted by simply slightly loosening the spring bolts 24, retracting the trolling motor 1 into the retracted position illustrated in phantom in FIG. 1, loosening the adjusting bolts 38 while the trolling motor 1 remains in the retracted configuration and placing the tension adjusting bolts 38 in selected ones of the spring tension apertures 39 located in the side flanges 33 of the deck fixture 27, respectively. For example, locating the tension adjusting bolt 38 in the upper spring tension aperture 39 creates maximum tension in the torsion springs 34. Conversely, location of the tension adjusting bolts 38 in the bottom spring torsion apertures 39 creates minimum tension in the torsion springs 34 as they operate to assist in raising and lowering the trolling motor 1.

It will be appreciated by those skilled in the art that while the preferred embodiments of the invention have been described above, various modifications may be made therein and the appended claims are intended to cover all such modifications which may fall within the spirit and scope of the invention. One such modification, by way of example, is a cover (not illustrated)

which can be fabricated for the torsion springs 34 in order to enhance the appearance of the raising and lowering aid 11.

Accordingly, having described my invention with the particularity set forth above, what is claimed is:

1. In a retractable trolling motor apparatus having a mount bracket which includes a mount shoe, a shaft bracket carrying a trolling motor and a pair of primary arms extending between the mount shoe and the mount bracket, the improvement comprising a pair of torsion springs disposed in spaced relationship on each side of the mount shoe with one end of each of said torsion springs fixed with respect to the mount shoe; a pair of connector bars having one end thereof pivotally mounted with respect to the mount shoe in spaced relationship, with the opposite ends of said torsion springs attached to said one end of said connector bars, respectively, and the opposite ends of said connector bars extending in close proximity to the primary arms, respectively; a keeper plate joining said opposite ends of said connector bars; and roller means carried by said opposite ends of said connector bars, said roller means contacting the primary arms and adapted for traversal of the primary arms responsive to retraction and extension of the trolling motor apparatus.

2. The trolling motor apparatus of claim 1 further comprising a deck fixture secured to the mount shoe and wherein said one end of each of said torsion springs is fixedly secured to said deck fixture and said one end of each of said connector bars is pivotally secured to said deck fixture.

3. The trolling motor bracket of claim 2 further comprising a pair of spring mandrels positioned inside said torsion springs, respectfully, and a pair of spring bolts extending through said one end of said connector bars and said spring mandrels, respectively, said spring bolts threadibly engaging said deck fixture for securing said connector bars, said torsion springs and said spring mandrels to said deck fixture.

4. The trolling motor bracket of claim 3 further comprising a pair of stop disks located between said spring mandrels and said one end of said connector bars, respectively, and a disk flange carried by each of said stop disks, said disk flange positioned in the path of said opposite ends of said torsion springs and said stop disks adjustable with respect to said spring mandrels for arresting the pivot of said opposite ends of said torsion springs by contact between said opposite ends of said torsion springs and said disk flange, respectively.

5. The trolling motor bracket of claim 4 further comprising spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture.

6. The trolling motor bracket of claim 4 further comprising a pair of spring anchor means secured to said one end of said connector bars and receiving said opposite ends of said torsion springs, respectively, for securing said opposite ends of said tension springs to said one end of said connector bars, respectively.

7. The trolling motor bracket of claim 4 further comprising:

(a) spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture; and (b) a pair of spring anchor means secured to said one end of said connector bars and receiving said opposite ends of said torsion springs, respectively, for securing said opposite ends of said tension springs to said one end of said connector bars, respectively.

8. The trolling motor bracket of claim 3 further comprising keeper means projecting from each of said spring mandrels, said keeper means engaging said mount shoe for securing said spring mandrels to said mount shoe.

9. The trolling motor of claim 3 further comprising:

(a) a pair of stop disks located between said spring mandrels and said one end of said connector bars, respectively, and a disk flange carried by each of said stop disks, said disk flange positioned in the path of said opposite ends of said torsion springs and said stop disks adjustable with respect to said spring mandrels for arresting the pivot of said opposite ends of said torsion springs by contact between said opposite ends of said torsion springs and said disk flange;

(b) spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture;

(c) a pair of spring anchor means secured to said one end of said connector bars and receiving said opposite ends of said torsion springs, respectively, for securing said opposite ends of said tension springs to said one end of said connector bars, respectively; and (d) keeper means projecting from each of said spring mandrels, said keeper means engaging said mount shoe for securing said spring mandrels to said mount shoe.

10. In a retractable trolling motor apparatus for mounting on boats, the trolling motor apparatus having a mount bracket which includes a mount shoe secured to the boat deck, a shaft bracket carrying a trolling motor, a pair of primary arms pivotally carried by the mount shoe and the mount bracket in parallel relationship and at least one stabilizing arm spaced from the primary arms and pivotally carried by the mount shoe and the shaft bracket, wherein the primary arms and stabilizing arm facilitate retraction and extension of the trolling motor to and from the mount shoe, the improvement comprising a deck fixture removably carried by the mount shoe, said deck fixture having upward standing, substantially parallel side flanges; a pair of generally cylindrically-shaped mandrels carried by said side flanges; a pair of torsion springs wound on said mandrels, with one end of each of said torsion springs engaging said side flanges of said deck fixture, respectively; a pair of connector bars having one end pivotally carried by said mandrels in spaced relationship, respectively, with the opposite ends of said connector bars extending in close proximity to said primary arms, respectively; a keeper plate provided with connecting flanges and said connecting flanges pivotally attached to said opposite ends of said connector bars; and roller means rotatably carried by said connecting bars and positioned in rotatable contact with the primary arms, respectively, whereby manipulation of the trolling motor in extended configuration outwardly of the mount shoe increases the tension in said torsion springs and retraction of the trolling motor on the mount shoe decreases the tension in said torsion springs.

11. The trolling motor of claim 10 further comprising a pair of stop disks located between said spring mandrels and said one end of said connector bars, respectively, and a disk flange carried by each of said stop disks, said disk flange positioned in the path of said opposite ends of said torsion springs, and said stop disks adjustable with respect to said spring mandrels for arresting the pivot of said opposite ends of said torsion springs by contact between said opposite ends of said torsion springs and said disk flange, respectively.

12. The trolling motor of claim 10 further comprising spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture.

13. The trolling motor of claim 10 further comprising:

(a) a pair of stop disks located between said spring mandrels and said one end of said connector bars, respectively, and a disk flange carried by each of said stop disks, said disk flange positioned in the path of said opposite ends of said torsion springs, and said stop disks adjustable with respect to said spring mandrels for arresting the pivot of said opposite ends of said torsion springs by contact between said opposite ends of said torsion springs and said disk flange, respectively; and (b) spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture.

14. The trolling motor bracket of claim 10 further comprising a pair of spring anchor means secured to said one end of said connector bars and receiving said opposite ends of said torsion springs, respectively, for securing said opposite ends of said tension springs to said one end of said connector bars, respectively.

15. The trolling motor bracket of claim 10 further comprising:

(a) a pair of stop disks located between said spring mandrels and said one end of said connector bars, respectively, and a disk flange carried by each of said stop disks, said disk flange positioned in the path of said opposite ends of said torsion springs and said stop disks adjustable with respect to said spring mandrels for arresting the pivot of said opposite ends of said torsion springs by contact between said opposite ends of said torsion springs and said disk flange;

(b) spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture; and (c) a pair of spring anchor means secured to said one end of said connector bars and receiving said opposite ends of said torsion springs, respectively, for securing said opposite ends of said tension springs to said one end of said connector bars, respectively.

16. The trolling motor bracket of claim 10 further comprising keeper means projecting from each of said mandrels and a keeper aperture provided in each of said side flanges for receiving said keeper means and preventing said mandrels from rotating with respect to said deck fixture.

17. The trolling motor of claim 10 further comprising threaded retainer means threaded in each of said side flanges and projecting through said flanges into contact with the mount shoe for securing said deck fixture to said mount shoe.

18. The trolling motor of claim 10 further comprising:

(a) keeper means projecting from each of said mandrels and a keeper aperture provided in each of said side flanges for receiving said keeper means and preventing said mandrels from rotating with respect to said deck fixture; and (b) threaded retainer means threaded in each of said side flanges and projecting through said flanges into contact with the mount shoe for securing said deck fixture to said mount shoe.

19. The trolling motor of claim 10 further comprising:

(a) a pair of stop disks located between said spring mandrels and said one end of said connector bars, respectively, and a disk flange carried by each of said stop disks, said disk flange positioned in the path of said opposite ends of said torsion springs and said stop disks adjustable with respect to said spring mandrels for arresting the pivot of said opposite ends of said torsion springs by contact between said opposite ends of said torsion springs and said disk flange;

(b) spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture;

(c) a pair of spring anchor means secured to said one end of said connector bars and receiving said opposite ends of said torsion springs, respectively, for securing said opposite ends of said tension springs to said one end of said connector bars, respectively;

(d) keeper means projecting from each of said mandrels and a keeper aperture provided in each of said side flanges for receiving said keeper means and preventing said mandrels from rotating with respect to said deck fixture; and (e) threaded retainer means threaded in each of said side flanges and projecting through said flanges into contact with the mount shoe for securing said deck fixture to said mount shoe.

20. In a retractable trolling motor apparatus for mounting on boats, the trolling motor apparatus having a mount bracket which includes a mount shoe secured to the boat deck, a shaft bracket carrying a trolling motor, a pair of primary arms pivotally carried by the mount shoe and the mount bracket in parallel relationship and at least one stabilizing arm spaced from the primary arms and pivotally carried by the mount shoe and the shaft bracket, wherein the primary arms and stabilizing arm facilitate retraction and extension of the trolling motor to and from the mount shoe, the improvement comprising a deck fixture removably carried by the mount shoe, said deck fixture having upward standing, substantially parallel side flanges; threaded retainer means threaded in each of said side flanges and projecting through said flanges into contact with the mount shoe for securing said deck fixture to said mount shoe; a pair of generally cylindrically-shaped mandrels carried by said side flanges; a pair of torsion springs wound on said mandrels, with one end of each of said torsion springs positioned adjacent said deck fixture, respectively; spring tension apertures provided in spaced relationship in said deck fixture and a pair of tension adjusting bolts threadably engaging selected ones of said spring tension apertures, said tension adjusting bolts receiving said one end of said torsion springs, respectively, for adjustably securing said one end of said torsion springs in fixed relationship with respect to said deck fixture; a pair of connector bars having one end rotatably carried by said mandrels in spaced relationship, respectively, with the opposite ends of said connector bars extending in close proximity to said primary arms, respectively; a pair of stop disks located between said spring mandrels and said one end of said connector bars, respectively, and a disk flange carried by each of said stop disks, said disk flange positioned in the path of said opposite ends of said torsion springs and said stop disks adjustable with respect to said spring mandrels for arresting the pivot of said opposite ends of said torsion springs by contact between said opposite ends of said torsion springs and said disk flange; a pair of spring anchor means secured to said one end of said connector bars and receiving said opposite ends of said torsion springs, respectively, for securing said opposite ends of said tension springs to said one end of said connector bars, respectively; a keeper plate provided with connecting flanges and said connecting flanges pivotally attached to said opposite ends of said connector bars; and roller means rotatably carried by said connecting bars and positioned in rotatable contact with the primary arms, respectively, whereby manipulation of the trolling motor in extended configuration outwardly of the mount shoe increases the tension on said torsion springs and retraction of the trolling motor on the mount shoe decreases the tension in said torsion springs.

* * * * *